US009837026B2

(12) United States Patent
Lv

(10) Patent No.: US 9,837,026 B2
(45) Date of Patent: Dec. 5, 2017

(54) BACKLIGHT CONTROL METHOD, BACKLIGHT CONTROL DEVICE AND DISPLAY APPARATUS EMPLOYING A SYSTEM ON CHIP AND A FIELD-PROGRAMMABLE GATE ARRAY

(71) Applicants: BOE TECHNOLOGY GROUP CO., LTD., Beijing (CN); Beijing BOE Vision-Electronic Technology Co., Ltd., Beijing (CN)

(72) Inventor: Bendeng Lv, Beijing (CN)

(73) Assignees: BOE TECHNOLOGY GROUP CO., LTD., Beijing (CN); BEIJING BOE VISION-ELECTRONIC TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/316,103

(22) Filed: Jun. 26, 2014

(65) Prior Publication Data

US 2015/0228227 A1 Aug. 13, 2015

(30) Foreign Application Priority Data

Feb. 7, 2014 (CN) ..... 2014 1 0044775

(51) Int. Cl.
*G09G 3/34* (2006.01)

(52) U.S. Cl.
CPC ... *G09G 3/3406* (2013.01); *G09G 2320/0626* (2013.01)

(58) Field of Classification Search
CPC ..... G09G 3/3406
(Continued)

(56) References Cited

U.S. PATENT DOCUMENTS

2007/0153136 A1* 7/2007 Tseng ..... G09G 3/2092 348/790
2008/0143757 A1* 6/2008 Furihata ..... G09G 3/3406 345/690

(Continued)

FOREIGN PATENT DOCUMENTS

CN 101202017 A 6/2008
CN 101281734 * 10/2008

(Continued)

OTHER PUBLICATIONS

CN101281734 Espacenet Translation.*

(Continued)

*Primary Examiner* — Lisa Landis
(74) *Attorney, Agent, or Firm* — Kinney & Lange, P.A.

(57) ABSTRACT

The present invention provides a backlight control method, a backlight control device and a display apparatus. The backlight control method comprises steps of: acquiring a backlight information and writing the backlight information into a backlight register of system on chip; obtaining a backlight adjusting data based on the backlight information in the backlight register; sending the backlight adjusting data to a backlight control register of a field-programmable gate array, so that the backlight control register obtains a corresponding backlight control register value based on the backlight adjusting data; and adjusting backlight according to the backlight control register value. By correlating backlight option function in the system on chip (SOC) with the field-programmable gate array (FPGA) panel, the users can accomplish the control of the displayed backlight through the menus displayed on the display apparatus. This improves the using experience of the users.

13 Claims, 2 Drawing Sheets

(58) Field of Classification Search
USPC ..... 345/102
See application file for complete search history.

(56) References Cited

U.S. PATENT DOCUMENTS

| | | | | |
|---|---|---|---|---|
| 2009/0108768 | A1 | 4/2009 | Yang et al. | |
| 2009/0167194 | A1* | 7/2009 | Mizuta | G09G 3/2088 315/151 |
| 2012/0154392 | A1* | 6/2012 | Kim | G02B 26/06 345/419 |
| 2015/0279312 | A1* | 10/2015 | Tan | G09G 3/2096 345/208 |

FOREIGN PATENT DOCUMENTS

| | | | |
|---|---|---|---|
| CN | 101281734 | A | 10/2008 |
| CN | 101937654 | A | 1/2011 |
| CN | 103345909 | A | 10/2013 |

OTHER PUBLICATIONS

The Chinese First Office Action dated May 29, 2015 for Chinese Application No. 201410044775.9.
Chinese Office Action (and English translation) dated Nov. 16, 2015, for corresponding Chinese Application No. 201410044775.9.
Third Chinese Office Action (and English translation) dated Apr. 12, 2016, for corresponding Chinese Application No. 201410044775.9.
Chinese Rejection Decision (and English translation) dated Jul. 6, 2016, for corresponding Chinese Application No. 201410044775.9.

* cited by examiner

BACKLIGHT CONTROL METHOD, BACKLIGHT CONTROL DEVICE AND DISPLAY APPARATUS EMPLOYING A SYSTEM ON CHIP AND A FIELD-PROGRAMMABLE GATE ARRAY

CROSS-REFERENCE TO RELATED APPLICATION

This application claims the benefit of Chinese Patent Application No. 201410044775.9 filed on Feb. 7, 2014 in the State Intellectual Property Office of China, the whole disclosure of which is incorporated herein by reference.

BACKGROUND OF THE INVENTION

Field of the Invention

Embodiments of the present invention relate to the field of the display technology, and in particular, to a backlight control method, a backlight control device and a display apparatus.

Description of the Related Art

With the continuous improvement of the display technology, people's requirements to the resolution and the large size of the displayers are continuously improved. A UD (Ultra High Definition) display apparatus with higher display resolution is developed, and is gradually broadly applied. Comparing with traditional HD (High Definition) and full HD (full High Definition) display apparatus, the physical resolution of the UD ultra high definition display apparatus can generally reach 3840*2160 (4K*2K) or more, the total number of pixels thereof reaches above 8 million or more, which is 8 times the number of pixels of the available HD (physical solution of 1366*768) display apparatus and 4 times the number of pixels of the Full HD (physical solution of 1920*1080) display apparatus.

For the UD display apparatus, the 4K*2K image information inputted into the display screen generally are derived from the FPGA (Field-Programmable Gate Array) panel. In particular, FHD (1920*1080) image signals are inputted into the FPGA through the SOC (System on Chip), then the FHD (1920*1080) image signals are converted into UD (3840*2160) image signals by the FPGA, and thereby the UD (3840*2160) display apparatus is driven to display. In the UD display apparatus, the control of displaying backlight is usually performed by the FPGA. But for the UD display apparatus of the prior art, a more effective method is needed to realize the control of displaying backlight.

SUMMARY OF THE INVENTION

The present invention provides a backlight control method, a backlight control device and a display apparatus, and thus the control of displaying backlight can be realized.

According to the embodiment of one aspect of the present invention, there is provide a backlight control method, comprising steps of: acquiring a backlight information and writing the backlight information into a backlight register of system on chip; obtaining a backlight adjusting data based on the backlight information in the backlight register; sending the backlight adjusting data to a backlight control register of a field-programmable gate array, so that the backlight control register obtains a corresponding backlight control register value based on the backlight adjusting data; and adjusting backlight according to the backlight control register value.

According to the embodiment of a further aspect of the present invention, there is provide a backlight control device comprising:

- a backlight information acquiring module configured to acquire a backlight information from a backlight register of a system on chip;
- a backlight data calculating module configured to obtain a backlight adjusting data from the acquired backlight information;
- a backlight data sending module configured to send the backlight adjusting data;
- a backlight control register provided in a field-programmable gate array, the backlight control register is configured to obtain a corresponding backlight control register value based on the backlight adjusting data from the backlight data sending module; and
- a backlight adjusting module configured to adjust backlight according to the backlight control register value.

According to the embodiment of a still further aspect of the present invention, there is provide a display apparatus comprising the backlight control device according to the above embodiment.

BRIEF DESCRIPTION OF THE DRAWINGS

To more clearly illustrate the technical solutions of the prior art or the embodiments of the present invention, the figures needed in the description of the prior art or the embodiments are simply depicted. Apparently, figures in the below description are only some of exemplary embodiments of the present invention. For those skilled in the art, other figures can be obtained according to these figures without exercising creative effort.

DETAILED DESCRIPTION OF PREFERRED EMBODIMENTS OF THE INVENTION

The technical solutions in the embodiments of the present invention will be described clearly and completely hereinafter with reference to the attached drawings in the embodiments of the present invention. Apparently, the described embodiments are only part of the exemplary embodiments of the present invention and are not tended to covering all of the embodiments. Based on the exemplary embodiments in the present invention, all the other embodiments made by those skilled in the art without exercising creative efforts fall into the protection scope of the present invention.

In addition, in the following detailed description, for the purposes of convenient explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
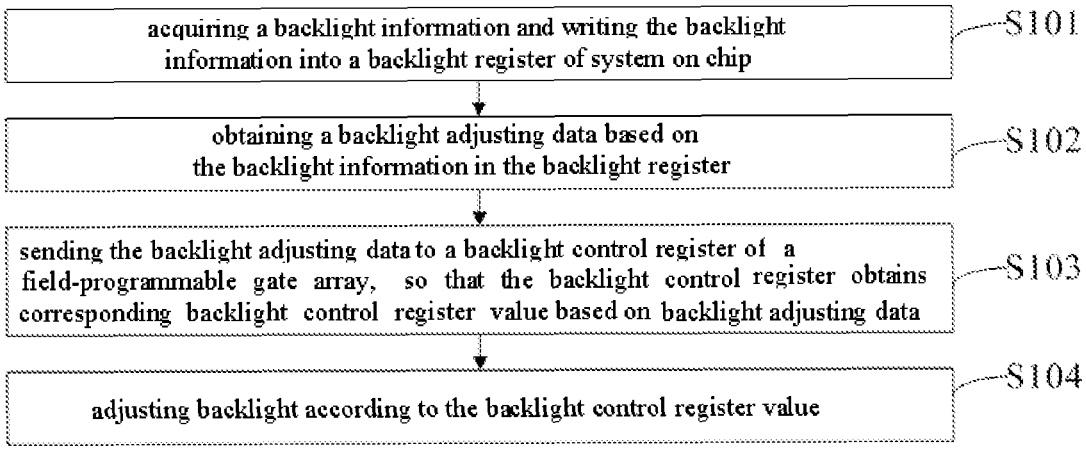
FIG. 1 is a flow schematic chart of the backlight control method according to an exemplary embodiment of the present invention.

As shown in FIG. 1, the backlight control method according to one exemplary embodiment of the present invention comprises steps of: S101, acquiring backlight information and writing the backlight information into a backlight register of a system on chip (SOC), wherein, the backlight information can comprise many kinds of information, for example, can comprise a brightness of a backlight of a display apparatus, the light-up region of the backlight and etc, however, the present invention is not limited to this. In the embodiments of the present invention, the backlight information can be derived from the backlight adjusting information inputted by the users.

The backlight control method of the embodiment of the present invention further comprises steps of: S102, obtaining a backlight adjusting data based on the backlight information in the backlight register; S103, sending the backlight adjusting data to a backlight control register of the field-programmable gate array (FPGA), so that the backlight control register obtains the corresponding a backlight control register value based on the backlight adjusting data. In the embodiment of the present invention, the backlight control register is provide on a field-programmable gate array for inputting an ultra high definition (UD) image information of 4K*2K into a display screen; and S104, adjusting the backlight according to the backlight control register value.

With the backlight control method of the embodiment of the present invention, the acquired backlight information is written into the backlight register of the system on chip, the backlight adjusting data is derived from the backlight information in the backlight register, and the backlight adjusting data is sent to the backlight control register of the field-programmable gate array, so that the backlight control register obtain the corresponding the backlight control register value from the backlight adjusting data, and realizes the backlight adjustment according to the backlight control register value. Thus, the system on chip can input the full high definition (FHD) image signal into the field-programmable gate array, and also send the backlight adjusting data obtained from the backlight information to the backlight control register of the field-programmable gate array, and thereby correlating the backlight option function in the system on chip (SOC) with the field-programmable gate array (FPGA) panel. In this way, the display apparatus can display the ultra high definition image information and the backlight adjusting information from the field-programmable gate array, so that the users can accomplish the control of the backlight of the display apparatus through the menus displayed on the display apparatus. This further perfects the function of the display apparatus and improves the using experience of the users remarkably.

Figure 2:
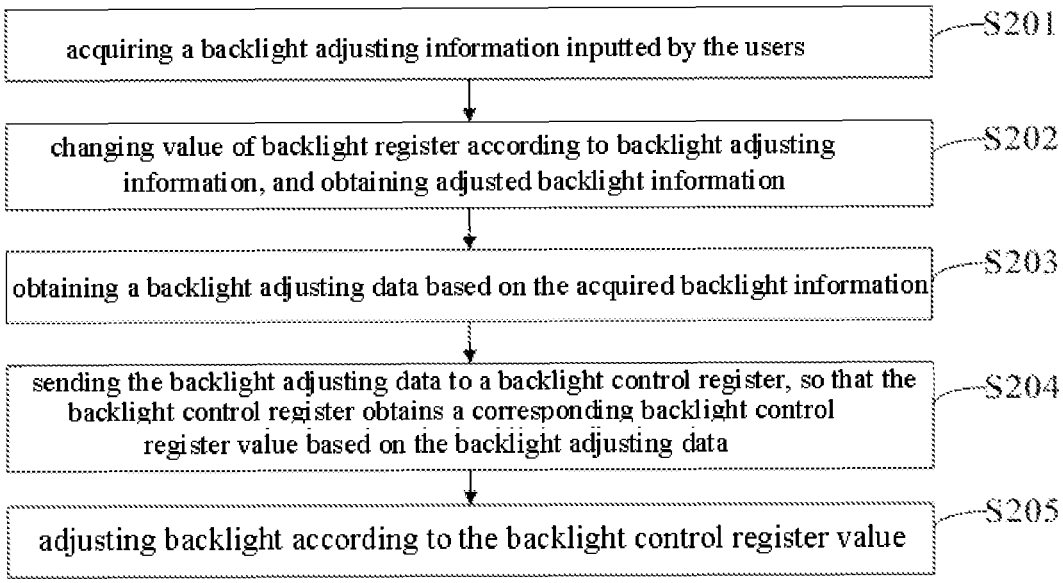
FIG. 2 is a flow schematic chart of the backlight control method according to a further exemplary embodiment of the present invention.

In the practical process of using the 4K*2K smart television, the backlight control method provided by the embodiment of the present invention can also be used to realize the control of the backlight. In particular, as shown in FIG. 2, the backlight control method of a further embodiment of the present invention comprises steps of: S201, acquiring a backlight adjusting information inputted by the users; S202, changing a value of a backlight register according to the backlight adjusting information, and obtaining the adjusted backlight information; S203, obtaining a backlight adjusting data based on the acquired backlight information; S204, sending the backlight adjusting data to a backlight control register to enable the backlight control register to obtain a corresponding backlight control register value based on the backlight adjusting data; and S205, adjusting backlight according to the backlight control register value.

Furthermore, the backlight adjusting information can comprise at least one of many kinds of adjusting information, such as the lightness of the display apparatus, the light-up region of the backlight and etc. In particular, the users can realize the input of the backlight adjusting information of the television through many means, such as infrared remote control, touch control, sound control and etc; the present invention is not limited to this.

In the step of changing the value of the backlight register according to the backlight adjusting information and obtaining the adjusted backlight information, in terms of backlight brightness adjustment, a corresponding correlation table of the backlight register value and the backlight brightness can be pre-stored in the backlight register, by writing a backlight brightness adjusting information contained in the backlight adjusting information into this backlight register, the value of backlight register is thus changed, then the backlight information after the adjustment of the television backlight brightness is obtained.

In the step of obtaining the backlight adjusting data based on the acquired backlight information, the backlight adjusting data in one-to-one correspondence to this backlight information can be obtained from the acquired backlight information, wherein, the backlight information can be within a first value range and the backlight adjusting data can be within a second value range.

For example, in one exemplary embodiment, as quantified backlight brightness, the backlight information can be varied within the range of 0-100. In correspondence to this backlight information, backlight display gray scale values in one-to-one correspondence to the backlight information can be obtained through preset mapping relation. This backlight display gray scale values are the backlight adjusting data. Generally, the range of this display gray scale values are within 0-255. Wherein, the one-to-one corresponding mapping relation can be a preset table. The backlight display gray scale values in one-to-one correspondence to the backlight information can be obtained through operations such as looking-up table and etc.

In the step of S204, a backlight data packet can be obtained from the acquired backlight adjusting data. This backlight data packet comprises the backlight adjusting data, a data bus device address of this backlight control register and a data bus register address of the backlight control register.

In the embodiments of the present invention, the data bus can particularly employ IIC (Inter-Integrated Circuit) bus. The backlight data packet can be sent to the backlight control register through the data bus, so that the backlight control register value in correspondence to the register address can be amended.

In the step of adjusting the backlight according to the backlight control register value, when the change of the backlight control register value is read by the backlight adjusting module, the output of the backlight data can be correspondingly adjusted, so that the output power of the four power source panels for driving the backlight source can be controlled and the control of the backlight source of the display apparatus, such as the television, can be accomplished.

By adopting the above backlight control method, the backlight option function in the system on chip (SOC) can be correlated with the field-programmable gate array (FPGA) panel. Thus the users are enabled to accomplish the control of the backlight of the display apparatus through the menus, and user experience is remarkably improved.

Figure 3:
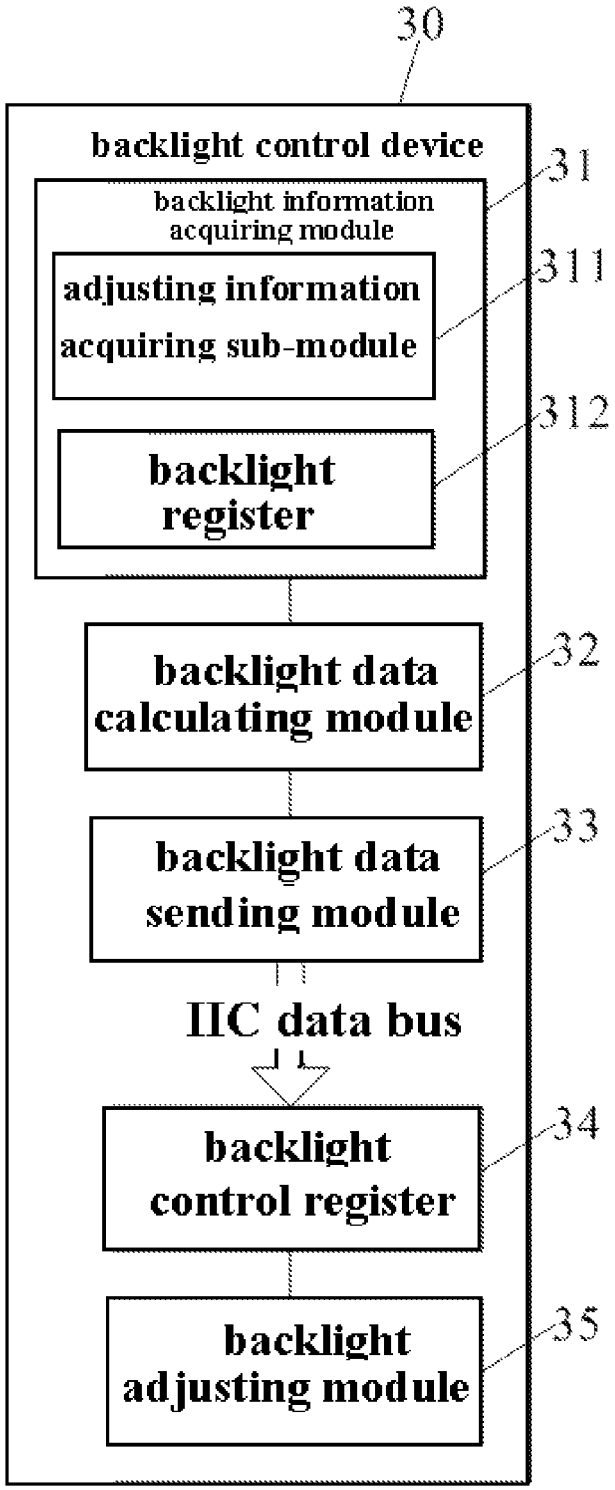
FIG. 3 is a principal block diagram of the backlight control device according to an exemplary embodiment of the present invention.

According to the exemplary embodiment of another aspect of the present invention, there is further provided a backlight control device 30, as shown in FIG. 3, comprising: a backlight information acquiring module 31 configured to acquire a backlight information; a backlight data calculating module 32 configured to obtain a backlight adjusting data based on the acquired backlight information; a backlight data sending module 33 configured to send the backlight adjusting data; a backlight control register 34 provided in a field-programmable gate array panel and configured to obtain a corresponding backlight control register value based on the backlight adjusting data from the backlight control register; and a backlight adjusting module 35 configured to adjust the backlight according to the backlight control register value.

In one exemplary embodiment, the backlight information acquired by the backlight information acquiring module 31 can comprise many kinds of information, for example, the backlight information can comprise the brightness of the display apparatus, the light-up region of the backlight and etc, the present invention is not limited to this. In the embodiments of the present invention, the backlight information can be derived from the backlight adjusting information inputted by the users.

In a further embodiment, the backlight calculating module 32 can also be used for obtaining the backlight adjusting data in one-to-one correspondence to the backlight information based on the acquired backlight information; wherein, the backlight information can be within a first value range and the backlight adjusting data can be within a second value range.

In a further embodiment, the backlight data sending module 33 can also be used for obtaining a backlight data packet from the backlight adjusting data. This backlight data packet can comprise the backlight adjusting data, a data bus device address of the backlight control register and a data bus register address of the backlight control register. In this way, the backlight data packet can be sent to the backlight control register through the data bus, so that the backlight control register value in correspondence to the register address can be amended.

The backlight control device according to the embodiment of the present invention may acquire the backlight information, obtain the backlight adjusting data from the acquired backlight information, and send the backlight adjusting data to the backlight control register, so that the backlight control register to obtain the corresponding backlight control register value from the backlight adjusting data, thereby realizing the backlight adjustment according to this backlight control register value. Further, in this backlight control device, the system on chip can not only input the full high definition (FHD) image signal into the field-programmable gate array, but also send the backlight adjusting data obtained from the backlight information to the backlight control register of the field-programmable gate array, and thus the backlight option function in the system on chip (SOC) is associated to the field-programmable gate array (FPGA) panel. In this way, the display apparatus can display the ultra high definition image information and the backlight adjusting information from the field-programmable gate array, thus the users can accomplish the control of the backlight of the display apparatus through the menus displayed on the display apparatus. This further perfects the function of the display apparatus and improves the using experience of the users remarkably.

Furthermore, as shown in FIG. 3, the backlight information acquiring module 31 can comprise: an adjusting information acquiring sub-module 311 configured to obtain the backlight adjusting information inputted by the users; and a backlight register 312 configured to change the value of the backlight register according to the backlight adjusting information and obtaining the adjusted backlight information.

In one embodiment, the backlight adjusting information can comprise at least one of many kinds of adjusting information, such as the lightness of the display apparatus, the light-up region of the backlight and etc. In particular, the users can realize the input of the backlight adjusting information of the television through many means, such as infrared remote control, touch control, sound control and etc, the present invention is not limited to this.

In one embodiment, in terms of the backlight brightness adjustment, a corresponding correlation table of the backlight register value and the backlight brightness can be preset in the backlight register, by writing the backlight brightness adjusting information contained in the backlight adjusting information into this backlight register, the value of backlight register is thus changed, then the backlight information after the adjustment of the television backlight brightness is obtained.

In the practical process of using the 4K*2K smart television, the backlight control device provided by the embodiment of the present invention can also be used to realize the control of the backlight. In particular, as shown in FIG. 3, the process of the backlight control device 30 of the embodiment of the present invention for realizing the backlight control is as follows.

The adjusting information acquiring sub-module 311 acquires the instructions from for example the key or the remote controller, converts the value of the backlight adjusting option into the software instructions, and writes the software instructions into the backlight register 312 of the system on chip (SOC), wherein, the value of the backlight register 312 of the SOC is within the range of 0-100.

The backlight data calculating module 32 acquires the value from the backlight information of the backlight register 312 of the SOC, converts the current value into data ranging from 0 to 255 at equal proportion. For example, the values from the backlight information of the backlight register 312 are all multiplied by the factor 2.55 and the backlight adjusting data is thus obtained. After obtaining the backlight adjusting data, the backlight data calculating module 32 transmits the backlight adjusting data to the backlight data sending module 33.

The data sending module 33 packets the current backlight adjusting data into instructions with FPGA IIC device address and FPGA IIC backlight register address, and sends the instructions to the backlight control register 34 of the field-programmable gate array (FPGA) through IIC data bus, thereby accomplishing amendments to the backlight control register 34 of the FPGA.

Through reading the amendments to the backlight control register 34 of the FPGA, the backlight adjusting module 35 of the FPGA adjusts the output of the backlight data correspondingly, and controls the output power of the four power source panel for driving the backlight source respectively, and thus accomplishes the control of the backlight source of the television (not shown in FIG. 30).

According to the backlight control method and backlight control device of the embodiments of the present invention, the system on chip can not only input the full high definition (FHD) image signal into the field-programmable gate array, but also send the backlight adjusting data obtained from the backlight information to the backlight control register of the field-programmable gate array, and thus the backlight option function in the system on chip (SOC) is correlated with the field-programmable gate array (FPGA) panel. In this way, the display apparatus can display the ultra high definition image information and the backlight adjusting information from the field-programmable gate array, thus the users are enabled to accomplish the control of the backlight of the display apparatus through the menus. This improves the using experience of the users remarkably.

In addition, the embodiment of a further aspect of the present invention also provide a display apparatus comprising the backlight control device 30 according to the above various embodiments.

Please be noted that the display device provided by the present invention can comprise: liquid crystal panel, electronic paper, liquid crystal television, liquid crystal displayer, digital photo frame, mobile telephone, panel computer and any other products or components with backlight display function.

Wherein, the structure of the backlight control device 30 has been described in detail in the foregoing embodiments, and will not be repeated herein.

The display apparatus provided by the embodiments of the present invention comprises the backlight control device, the backlight control device is configured to acquire the backlight information, obtain the backlight adjusting data from the acquired backlight information, and send the backlight adjusting data to the backlight control register, so that the backlight control register can obtain the corresponding backlight control register value from the backlight adjusting data, and realize the backlight adjustment according to the backlight control register value. By using the backlight control method of the embodiments of the present invention, the backlight option function in the SOC is correlated with the FPGA panel, thus the users can accomplish the control of the backlight of the display apparatus through the menus. This further perfects the function of the apparatus and improves the using experience of the users remarkably.

It is appreciated for those skilled in the art that all or part of the process realizing the above method embodiments can be accomplished through hardware correlated with the computer program instructions. The above program can be stored in the computer readable storage medium. When performing the program, the steps contained in the above method embodiment are performed. The foregoing storage medium comprises: ROM, RAM, diskette, CD or various medium that can store program code.

The foregoing is only preferred embodiments of the present invention, but the protection scope of the present invention is not limited thereto. It would be appreciated by those skilled in the art that under the disclosure scope of the present invention, various changes or modifications may be made and be contained in the protection scope of the present invention. The scope of the present invention is defined in the claims and their equivalents.

What is claimed is:

1. A backlight control method, comprising steps of:

inputting backlight adjusting information into a display apparatus through infrared remote control, touch control or sound control by a user, acquiring backlight information and writing the backlight information into a backlight register of a system on chip of the display apparatus;

obtaining backlight adjusting data based on the backlight information in the backlight register;

inputting a full high definition image signal into a field-programmable gate array of the display apparatus, which is configured to input an ultra high definition image information into a display screen of the display apparatus by the system on chip;

sending the backlight adjusting data to a backlight control register of the field-programmable gate array, so that the backlight control register obtains a corresponding backlight control register value based on the backlight adjusting data and the display screen of the display apparatus displays the ultra high definition image information and the backlight adjusting information from the field-programmable gate array; and adjusting backlight according to the backlight control register value.

2. The backlight control method according to claim 1, wherein the step of obtaining the backlight adjusting data based on the backlight information in the backlight register comprises:

obtaining backlight adjusting data in one-to-one correspondence to the backlight information based on the backlight information in the backlight register;

wherein the backlight information is within a first value range and the backlight adjusting data is within a second value range.

3. The backlight control method according to claim 2, wherein a table is preset, and the backlight adjusting data in one-to-one correspondence to the backlight information is obtained by looking-up the table.

4. The backlight control method according to claim 1, wherein the step of sending the backlight adjusting data to the backlight control register of the field-programmable gate array comprises:

obtaining a backlight data packet based on the backlight adjusting data, the backlight data packet comprising the backlight adjusting data, a data bus device address of the backlight control register and a data bus register address of the backlight control register; and sending the backlight data packet to the backlight control register through a data bus to amend the backlight control register value in correspondence to the register address.

5. The backlight control method according to claim 4, wherein the data bus comprises an integrated circuit bus.

6. A backlight control device, comprising:

a backlight information acquiring module configured to acquire backlight information from a backlight register of a system on chip, the system on chip being configured to input a full high definition image signal into a field-programmable gate array, which is configured to input an ultra high definition image information into a display screen of a display apparatus, and the backlight information acquiring module comprising:

an adjusting information acquiring sub-module configured to obtain backlight adjusting information inputted into the display apparatus-a through infrared remote control, touch control or sound control by a user; and a backlight register configured to change the value of the backlight register according to the backlight adjusting information and acquire the backlight information;

a backlight data calculating module configured to obtain backlight adjusting data from the acquired backlight information;

a backlight data sending module configured to send the backlight adjusting data;

a backlight control register provided in the field-programmable gate array, the backlight control register being configured to obtain a corresponding backlight control register value based on the backlight adjusting data from the backlight data sending module, so that the display screen of the display apparatus displays the ultra high definition image information and the backlight adjusting information from the field-programmable gate array; and a backlight adjusting module configured to adjust backlight according to the backlight control register value.

7. The backlight control device according to claim 6, wherein the backlight data calculating module is further configured to obtain the backlight adjusting data in one-to-one correspondence to the backlight information based on the acquired backlight information, wherein the backlight information is within a first value range and the backlight adjusting data is within a second value range.

8. The backlight control device according to claim 6, wherein the backlight data sending module is further configured to:

obtain a backlight data packet based on the backlight adjusting data, the backlight data packet comprising the backlight adjusting data, a data bus device address of the backlight control register and a data bus register address of the backlight control register; and send the backlight data packet to the backlight control register through a data bus to amend the backlight control register value in correspondence to the register address.

9. The backlight control device according to claim 7, wherein, the data bus comprises an integrated circuit bus.

10. A display apparatus, comprising a display screen and a backlight control device, the backlight control device comprising:

a backlight information acquiring module configured to acquire a backlight information from a backlight register of a system on chip, the system on chip being configured to input full high definition image signal into a field-programmable gate array, which is configured to input an ultra high definition image information into the display screen, and the backlight information acquiring module comprising:

an adjusting information acquiring sub-module configured to obtain the backlight adjusting information inputted into the display apparatus through infrared remote control, touch control or sound control by a user; and a backlight register configured to change the value of the backlight register according to the backlight adjusting information and acquire the backlight information;

a backlight data calculating module configured to obtain backlight adjusting data from the acquired backlight information;

a backlight data sending module configured to send the backlight adjusting data;

a backlight control register provided in the field-programmable gate array, the backlight control register being configured to obtain a corresponding backlight control register value based on the backlight adjusting data from the backlight data sending module, so that the display screen displays the ultra high definition image information and the backlight adjusting information from the field-programmable gate array; and a backlight adjusting module configured to adjust backlight according to the backlight control register value.

11. The display apparatus according to claim 10, wherein the backlight data calculating module is further configured to obtain the backlight adjusting data in one-to-one correspondence to the backlight information based on the acquired backlight information, wherein the backlight information is within a first value range and the backlight adjusting data is within a second value range.

12. The display apparatus according to claim 10, wherein the backlight data sending module is further configured to:

obtain a backlight data packet based on the backlight adjusting data, the backlight data packet comprising the backlight adjusting data, a data bus device address of the backlight control register and a data bus register address of the backlight control register; and send the backlight data packet to the backlight control register through a data bus to amend the backlight control register value in correspondence to the register address.

13. The display apparatus according to claim 12, wherein the data bus comprises an integrated circuit bus.

* * * * *